US006855737B2

(12) United States Patent
Newton

(10) Patent No.: US 6,855,737 B2
(45) Date of Patent: Feb. 15, 2005

(54) FISCHER-TROPSCH PROCESS

(75) Inventor: David Newton, Farnham (GB)

(73) Assignee: BP Exploration Operation Company Limited, London (GB)

( * ) Notice: Subject to any disclaimer, the term of this patent is extended or adjusted under 35 U.S.C. 154(b) by 110 days.

(21) Appl. No.: 10/297,252

(22) PCT Filed: May 23, 2001

(86) PCT No.: PCT/GB01/02345

§ 371 (c)(1),
(2), (4) Date: May 8, 2003

(87) PCT Pub. No.: WO01/94500

PCT Pub. Date: Dec. 13, 2001

(65) Prior Publication Data

US 2004/0106689 A1 Jun. 3, 2004

(30) Foreign Application Priority Data

Jun. 6, 2000 (GB) ..... 0013791

(51) Int. Cl.[7] ..... C07C 27/00

(52) U.S. Cl. ..... 518/705; 518/700; 518/711; 518/715; 518/719

(58) Field of Search ..... 518/700, 705, 518/711, 715, 719

(56) References Cited

U.S. PATENT DOCUMENTS

| | | | |
|---|---|---|---|
| 2,474,845 | A | 7/1949 | Jenny et al. |
| 2,680,126 | A | 6/1954 | Atwell |
| 2,810,739 | A | 10/1957 | Lake et al. |
| 5,776,988 | A | 7/1998 | Chaumette et al. |

*Primary Examiner*—J. Parsa
(74) *Attorney, Agent, or Firm*—Nixon & Vanderhye

(57) ABSTRACT

A process for the production of liquid hydrocarbon products from synthesis gas in a system comprising a reaction zone and a gas separation zone wherein the process comprises: a) in the reaction zone, contacting synthesis gas at elevated temperature and pressure with a suspension of a particulate Fischer-Tropsch catalyst in a liquid medium so as to convert at least a portion of the synthesis gas into liquid hydrocarbon products; b) discharging a product suspension comprising catalyst suspended in the liquid medium and the liquid hydrocarbon products from the reaction zone into the gas separation zone, the product suspension having unconverted synthesis gas dissolved and/or entrained therein; c) in the gas separation zone, separating a gaseous stream comprising unconverted synthesis gas from the product suspension; d) recycling at least a portion of the separated gaseous stream to the reaction zone; and e) recycling at least a portion of the degassed product suspension from the gas separation zone to the reaction zone.

26 Claims, 2 Drawing Sheets

FISCHER-TROPSCH PROCESS

The present invention relates to a process for the production of liquid hydrocarbons from a gaseous mixture comprising carbon monoxide and hydrogen (synthesis gas), in the presence of a Fischer-Tropsch catalyst. In particular, the present invention relates to the production of liquid hydrocarbons by contacting synthesis gas with a Fischer-Tropsch catalyst in a three-phase (liquid/gas/solid) fluidised bed.

The production of hydrocarbons by contacting synthesis gas with a Fischer-Tropsch catalyst, typically a cobalt or iron catalyst, which may be either supported or unsupported, has been known for a considerable number of years. Fischer-Tropsch processes have been operated commercially for example by Sasol Technology (Pty) Ltd in South Africa. Much of the early work on Fischer-Tropsch hydrocarbon synthesis was accomplished using fixed bed catalysts but in recent times attention has shifted to the use of liquid phase catalytic reactions largely because of the relative ease of removing the exothermic heat of reaction in such systems.

Fischer-Tropsch processes which employ particulate fluidised beds in slurry bubble column reactors are described in, for example, U.S. Pat. Nos. 5,348,982; 5,157,054; 5,252,613; 5,866,621; 5,811,468; and 5,382,748. Slurry bubble column reactors operate by suspending catalytic particles in a liquid and feeding gas phase reactants into the bottom of the reactor through a gas distributor which produces small gas bubbles. As the gas bubbles rise through the reactor, the reactants are absorbed into the liquid and diff-use to the catalyst where, depending on the catalytic system, they can be converted to both liquid and gaseous products. If gaseous products are formed, they enter the gas bubbles and are collected at the top of the reactor. Liquid products are recovered by passing the slurry through a filter which separates the liquid from the catalytic solids. A principal advantage of slurry reactors over fixed bed reactors is that the pressure of a circulating/agitated slurry phase greatly increases the transfer rate of heat to cooling surfaces built into the reactor. A distinct advantage of bubble columns over mechanically stirred reactors is that the required mixing is effected by the action of rising bubbles, a process significantly more efficient in energy than mechanical stirring.

In U.S. Pat. No. 5,776,988, a Fischer-Tropsch process is operated by passing liquid and gas through the reactor in an ascending flow so as to expand a particulate fluidised catalytic bed by at least 10% and up to 50% in relation to the height of the bed at rest and to place the catalyst in random movement in the liquid. By controlling the size and density of the catalytic particles, and the velocities of the gases and of the liquids, while taking into account the viscosity of the liquid and the operating conditions, the catalytic bed expands to a controlled height. The size of the catalyst is typically of mean equivalent diameter of between 100 and 5000 $\mu$m. This mode of operation has an advantage that the catalyst is more uniformly dispersed throughout the liquid medium allowing improvements in the operability and productivity of the process to be obtained.

However, there remains the need for further improvements in the mode of operation of a Fischer-Tropsch process. It has now been found that a Fischer-Tropsch process can be operated using a three phase fluidised bed without being constrained by the velocities of the liquid and gas or the size of the catalyst particles.

The present invention relates to a process for the production of liquid hydrocarbon products from synthesis gas in a system comprising a reaction zone and a gas separation zone wherein the process comprises:

a) in the reaction zone, contacting synthesis gas at elevated temperature and pressure with a suspension of a particulate Fischer-Tropsch catalyst in a liquid medium so as to convert at least a portion of the synthesis gas into liquid hydrocarbon products;

b) discharging a product suspension comprising catalyst suspended in the liquid medium and the liquid hydrocarbon products from the reaction zone into the gas separation zone, the product suspension having unconverted synthesis gas dissolved and/or entrained therein;

c) in the gas separation zone, separating a gaseous stream comprising unconverted synthesis gas from the product suspension;

d) recycling at least a portion of the separated gaseous stream to the reaction zone; and e) recycling at least a portion of the degassed product suspension from the gas separation zone to the reaction zone.

Advantages of the process of the present invention over conventional Fischer-Tropsch processes include:

1. the ability to eliminate the requirement of keeping the fluidised catalytic bed in the reaction zone;
2. the removal of the requirement to control the size and density of the catalyst particles and the velocities of the gas and liquid feeds to the reaction zone; and
3. operating with a catalyst of reduced particle size (mean particle size of less than 100 microns) which (i) promotes the catalytic reaction, (ii) improves product selectivities and minimises methane by-product make, and (iii) enables the catalyst to remain suspended in the liquid phase during recycle of the suspension to the reaction zone.

In the reaction zone, the particulate Fischer Tropsch catalyst is maintained in a suspended state by the action of the flow of liquid (comprising liquid medium and liquid hydrocarbon products) through the reaction zone. Suitably, the rate of flow of liquid through the reaction zone is equal to or greater than the terminal fall velocity of the catalyst particles.

The suspension may be cooled within the reaction zone using a heat exchanger, for example, heat transfer tubes, positioned within the suspension (three phase fluidised bed) in order to assist in removing exothermic heat of reaction from the system.

Preferably, the liquid hydrocarbon products comprise a mixture of hydrocarbons having a chain length of greater than 5 carbon atoms. Suitably, the liquid hydrocarbon products comprise a mixture of hydrocarbons having chain lengths of from 5 to about 90 carbon atoms. Preferably, a major amount, for example, greater than 60% by weight, of the hydrocarbons have chain lengths of from 5 to 30 carbon atoms. Suitably, the liquid medium comprises one or more of the liquid hydrocarbon products.

The gas separation zone may be part of the system inside or outside the reaction zone. In the gas separation zone, a gaseous recycle stream is separated from the suspension. The gaseous recycle stream may comprise gaseous by-products (methane), gaseous intermediate hydrocarbon products (gaseous products having 2 or 3 carbon atoms, in particular, ethane or propanes), vaporised low boiling liquid hydrocarbon products (e.g. pentanes, hexanes or hexenes), and vaporised water by-product, in addition to unconverted synthesis gas. These gases and vapours are discharged from the reaction zone together with the suspension (either dissolved or entrained in the suspension).

In a first embodiment of the present invention the gas separation zone is located outside of the reaction zone (hereinafter referred to as "external gas separation zone"). The reaction zone is operated full of suspension (i.e. without a headspace). Product suspension is discharged from the reaction zone and is passed to the external gas separation zone. The external gas separation zone is operated with a headspace from which the gaseous recycle stream is withdrawn. Preferably, the volume of the headspace is not more than 25%, more preferably not more than 10% of the volume of the external gas separation zone. It is envisaged that a heat exchanger, for example, cooling coils, may be present below the level of suspension in the external gas separation zone to assist in the removal of exothermic beat of reaction.

The gaseous recycle stream is preferably cooled before being recycled to the reaction zone, for example, by passing the gaseous recycle stream through an external heat exchanger, to further assist in the removal of exothermic heat of reaction from the system. The gaseous recycle stream may be cooled to below its dew point to form a two phase mixture of gas (synthesis gas, methane by-product, intermediate gaseous hydrocarbons) and condensed liquid (water by-product and low boiling liquid hydrocarbon products). The condensed liquid may be recycled to the reaction zone entrained in the gaseous stream. Alternatively, the condensed liquid may be separated from the gaseous recycle stream, for example, using a suitable gas-liquid separation means (e.g. a hydrocyclone, demister, gravity separator) and is recycled to the reaction zone, for example, using a nozzle. Preferably, excess water by-product is removed from the separated condensed liquids using a suitable separation means (e.g. a decanter), before recycling the condensed liquids to the reaction zone. It is envisaged that the external heat exchanger and gas-liquid separation means may be combined within a single unit in order to simplify recycling of the gaseous stream to the reaction zone.

Fresh synthesis gas (hereinafter "syngas") may be fed to the gaseous recycle stream, either upstream or downstream of the external beat exchanger. Where the syngas has not been pre-cooled, it is preferred that the syngas is fed to the gaseous recycle stream upstream of the heat exchanger. Preferably, the gaseous recycle stream is recycled to the reaction zone via a blower or compressor located downstream of the external heat exchanger. Suitably, the gaseous recycle stream is fed to the reaction zone via a gas sparger.

Preferably, a purge stream is taken from the gaseous recycle stream to prevent the accumulation of gaseous by-products, for example, methane, in the system. If desired, any gaseous intermediate products may be separated from the purge stream. Preferably, such gaseous intermediate products are recycled to the system where they may be converted to liquid hydrocarbon products. Preferably, the purge stream is taken downstream of the external heat exchanger.

In order to ensure that the particulate catalyst remains suspended in the liquid medium and liquid hydrocarbon products, degassed suspension may be withdrawn from at or-near the bottom of the external gas separation zone and may be at least in part reintroduced to the external gas separation zone (via a by-pass loop conduit) at a position below the level of suspension, preferably, immediately below the level of suspension, in the external gas separation zone. The suspension is passed around the by-pass loop conduit by means of a slurry pump. A product side stream may be taken from the by-pass loop conduit downstream of the slurry pump. The product side stream is passed to a product separation stage (described below) where liquid medium and liquid hydrocarbon products are separated from the particulate catalyst. An advantage of withdrawing the product side stream downstream of the slurry pump is that the pump can supply sufficient power to overcome any pressures drops in the product separation stage.

At least a portion of the degassed suspension from the external gas separation zone is recycled to the reaction zone (hereinafter referred to as "suspension recycle stream") via a slurry pump. It has been found that by selecting a particulate catalyst having a mean particle size of less than 100 microns that the particulate catalyst remains suspended in the suspension recycle stream. Fresh catalyst may be added either to the suspension recycle stream or directly into the reaction zone.

The suspension recycle stream may be subjected to further cooling, for example, by being passed through an external heat exchanger, before being recycled to the reaction zone. It is envisaged that the degassed suspension will contain residual gases/vapours (unconverted syngas, gaseous by-products, gaseous intermediate products, vaporised low boiling liquid hydrocarbon products and vaporised water by-product) in which case low boiling liquid hydrocarbon products and water by-product may condense in the heat exchanger. The residual gases may be separated from the condensed liquid and the degassed suspension using a suitable gas-liquid separation means (for example, a hydrocyclone). The separated residual gases may be withdrawn from the hydrocyclone and may be recycled to the reaction zone. The degassed suspension together with the condensed liquid is recycled to the reaction zone via a slurry pump (hereinafter referred to as suspension recycle stream). Suitably, a product side stream is taken from the suspension recycle stream downstream of the slurry pump and is passed to a product separation stage (described below). Fresh catalyst may be added either to the suspension recycle stream or directly into the reaction zone.

In a second embodiment of the present invention the gas separation zone is located inside the reaction zone (hereinafter referred to as an "internal gas separation zone"). Suitably, the internal gas separation zone comprises (i) a headspace into which a gaseous phase comprising unconverted syngas is disentrained from the suspension, and (ii) a quiescent region into which degassed suspension is discharged (i.e. a region through which gas bubbles are not passed). For example, a weir may be located in the upper part of the reaction zone in such a position as to control and maintain the expanded height of the fluidised bed. Suitably, suspension flows over the weir into a quiescent region of the reaction zone. Without wishing to be bound by any theory, it is believed that as the suspension flows over the weir gaseous phase is disentrained from the suspension into the headspace.

The gaseous phase which is present in the headspace of the internal gas separation zone comprises unconverted syngas and may additionally comprise gaseous by-products, gaseous intermediate products, vaporised low boiling liquid hydrocarbon products and vaporised water by-product A gaseous stream is withdrawn from the headspace. This gaseous stream is recycled to the reaction zone in an identical manner to the first embodiment of the present invention.

Preferably, degassed suspension is withdrawn from the quiescent region of the internal gas separation zone and at least a portion of the degassed suspension is recycled to the reaction zone. Preferably, the degassed suspension is cooled, for example, by being passed through an external heat exchanger, before being recycled to the reaction zone in an identical manner to the first embodiment of the present invention.

In both the first and second embodiments of the present invention, a stream comprising a low boiling solvent may be introduced into the reaction zone. It is also envisaged that a low boiling solvent could be introduced into the external gas separation zone of the first embodiment of the present invention. Low boiling solvent is defined herein as a solvent having a boiling point, at standard pressure, in the range of from 30 to 280° C., preferably from 30 to 210° C. Preferably, the low boiling solvent is selected from the group consisting of aliphatic hydrocarbons having from 5 to 10 carbon atoms, alcohols (preferably, alcohols having from 1 to 4 carbon atoms, in particular, methanol), and water. In order to simplify the process, it is preferred that the low boiling solvent is a low boiling liquid hydrocarbon product or mixtures thereof, such as hydrocarbon products having from 5 to 10 carbon atoms, in particular, pentanes, hexanes, or hexenes. Without wishing to be bound by any theory, it is believed that vaporisation of the low boiling solvent in the reaction zone aids and enhances the mixing of the gaseous reactants, liquid medium and the solid catalyst thereby increasing conversion of syngas to liquid hydrocarbon products. Moreover, vaporisation of the low boiling solvent in the reaction zone (and/or in the external gas separation zone of the first embodiment of the present invention) will also assist in removing some of the exothermic heat of reaction allowing more control over the product selectivities and minimising the production of gaseous by-products, for example, methane. Where a low boiling solvent is introduced into the reaction zone (and/or the external gas separation zone of the first embodiment of the present invention), the gaseous recycle stream will comprise vaporised low boiling solvent. Consequently, the condensed liquid formed upon cooling the gaseous recycle stream may additionally comprise low boiling hydrocarbon solvent.

Preferably, the ratio of hydrogen to carbon monoxide of the syngas used in the process of the present invention is in the range of from 1:1 to 3:1 by volume, typically 2:1 by volume. Impurities such as methane, carbon dioxide, nitrogen and water may be present in the syngas.

The syngas may be prepared using any of the processes known in the art including partial oxidation of hydrocarbons, steam reforming, and autothermal reforming. A discussion of these syngas production technologies is provided in "Hydrocarbon Processing" V78, N.4, 87–90, 92–93 (April 1999) and "Petrole et Techniques", N. 415, 86–93 (July-August 1998). It is also envisaged that the syngas may be obtained by catalytic partial oxidation of hydrocarbons in a microstructured reactor as exemplified in "IMRET 3: Proceedings of the Third International Conference on Microreaction Technology", Editor W Ehrfeld, Springer Verlag, 1999, pages 187–196. Alternatively, the syngas may be obtained by short contact time catalytic partial oxidation of hydrocarbonaceous feedstocks as described in EP 0303438. Preferably, the syngas is obtained via a "Compact Reformer" process as described in "Hydrocarbon Engineering", 2000, 5, (5), 67–69; "Hydrocarbon Processing", 79/9, 34 (September 2000); "Today's Refinery", 15/8, 9 (August 2000); WO 99/02254; and WO 200023689.

The catalyst which may be employed in the process of the present invention is any catalyst known to be active in Fischer-Tropsch synthesis. For example, Group VIII metals whether supported or unsupported are known Fischer-Tropsch catalysts. Of these iron, cobalt and ruthenium are preferred, particularly iron and cobalt, most particularly cobalt.

A preferred catalyst is supported on an inorganic refractory oxide. Preferred supports include silica, alumina, silica-alumina, the Group IVB oxides, titania (primarily in the rutile form) and most preferably zinc oxide. The supports generally have a surface area of less than about 100 $m^2/g$, preferably less than 50 $m^2/g$, more preferably less than 25 $m^2/g$, for example, about 5 $m^2/g$.

The catalytic metal is present in catalytically active amounts usually about 1–110 wt %, the upper limit being attained in the case of iron based catalysts, preferably 2–40 wt %. Promoters may be added to the catalyst and are well known in the Fischer-Tropsch catalyst art Promoters can include ruthenium (when it is not the primary catalyst metal), rhenium, hafnium, cerium, and zirconium, and are usually present in amounts less than the primary catalytic metal (except for ruthenium which may be present in coequal amounts), but the promoter:metal ratio should be at least 1:10. Preferred promoters are rhenium and hafnium.

A further advantage of the process of the present invention is that smaller catalyst particle sizes can be employed compared with a conventional slurry process. Preferably, the catalyst has a mean particle size of less than 100 microns, preferably less than 75 microns, more preferably less than 50 microns, most preferably less than 40 microns, for example, in the range 1 to 30 microns, preferably 5 to 20 microns. In contrast, a conventional slurry process will typically employ a catalyst having a particle size of greater than 40 microns. Advantages of smaller catalyst particle sizes include reducing the selectivity of the process of the present invention to methane by-product and also reducing the formation of heavier hydrocarbon products. It is also envisaged that larger catalyst particles can be employed, for example, the catalyst may have a mean particle size of up to 500 microns.

Preferably, the suspension of catalyst discharged into the gas separation zone comprises less than 40% wt of catalyst particles, more preferably 10 to 30% wt of catalyst particles, most preferably 10 to 20% wt of catalyst particles.

Suitably, the reaction zone of the process of the present invention comprises a vessel which may be a tank reactor or a tubular loop conduit.

Where the vessel of the reaction zone is a tank reactor, the suspension recycle stream is preferably introduced at or near the bottom of the tank reactor. Suitably, gas (gaseous recycle stream and any fresh syngas) is sparged into the reaction zone through a sparger. Preferably, the sparger is positioned near the bottom of the reaction zone. The tank reactor may be operated with or without a gas cap (headspace). Where the tank reactor is operated without a gas cap, the suspension is discharged to an external gas separation zone, preferably from at or near the top of the tank reactor. Where the tank reactor has a gas cap, the tank reactor will have an internal gas separation zone.

Where the vessel of the reaction zone is a tubular loop conduit, the suspension is moved around the loop conduit via one or more pumps and/or propellers positioned in the tubular loop conduit The loop conduit may be provided with one or more spargers. Preferably, the spargers are spaced apart along the length of the tubular loop conduit in which case each sparger discharges gas (gaseous recycle stream and any fresh syngas) into a section of the tubular loop conduit Preferably, a pump or propeller is positioned in each of the sections of the tubular loop conduit. A heat exchanger may be disposed along substantially the entire length of the tubular loop conduit or substantially along the length of each section of tubular loop conduit thereby providing improved temperature control. The tubular loop conduit may be operated with or without a gas cap (headspace). Where the loop conduit is operated without a gas cap the suspension is discharged to an external gas separation zone. Where the loop conduit has a gas cap, the tubular loop conduit will have an internal gas separation zone.

Preferably, the gas which is fed to the reaction zone comprises from 50 to 100% by volume of fresh syngas (make-up syngas).

The present invention can be operated in batch or continuous mode, the latter is preferred.

In a continuous process part of the degassed suspension is continuously removed from the system and is passed to a product separation stage where liquid medium and liquid hydrocarbon products are separated from the particulate catalyst. The product separation stage comprises a suitable liquid-solid separation means. Examples of suitable liquid-solid separation means include hydrocyclones, filters, gravity separators and magnetic separators. Alternatively, the liquid medium and liquid hydrocarbon products may be separated from the catalyst by distillation. Preferably, there are two or more product withdrawal lines (for two or more product side streams), each line leading to a dedicated solid-liquid separation means. This ensures continuous operation of the process by allowing one or more of the solid-liquid separation means to be taken off-line for cleaning. The catalyst is recycled as a concentrated slurry from the solid-liquid separation means to the reaction zone. The separated liquid (liquid medium, liquid hydrocarbon products, any low boiling hydrocarbon solvent and any water by-product) is passed to a product purification stage. The purification stage may be simplified by using a liquid hydrocarbon product as the liquid medium which eliminates the requirement to separate the liquid medium from the liquid hydrocarbon products. In the purification stage, any water by-product is removed from the liquid hydrocarbon products.

In order to prevent the accumulation of water by-product in the system it is preferred that at least a portion of the water by-product is removed from the suspension recycle stream (the suspension which is recycled from the gas separation zone to the reaction zone). This may be achieved by taking a side stream either directly from the gas separation zone or downstream of the gas separation zone. The liquid components of the side stream are separated from the particulate catalyst (as described above) and water by-product is removed from the separated liquids (also as described above) before recycling the liquid components back to the reaction zone. The separated catalyst may be recycled to the reaction zone as a concentrated slurry. It is envisaged that removal of water by-product from the system can be incorporated into the product separation stage, by recycling a portion of the separated liquids, from which water has been removed, back to the reaction zone.

The process of the invention is preferably carried out at a temperature of 180–280° C., more preferably 190–240° C.

The process of the invention is preferably carried out at a pressure of 5–50 bar, more preferably 15–35 bar, generally 20–30 bar.

The liquid hydrocarbon products from the product purification stage may be fed to a hydrocracking stage, for example, a catalytic hydrocracking stage which employs a catalyst comprising a metal selected from the group consisting of cobalt, molybdenum, nickel and tungsten supported on a support material such as alumina, silica-alumina or a zeolite. Preferably, the catalyst comprises cobalt/molybdenum or nickel/molybdenum supported on alumina or silica-alumina. Suitable hydrocracking catalysts include catalysts supplied by Akzo Nobel, Criterion, Chevron, or UOP.

BRIEF DESCRIPTION OF DRAWINGS

The invention will now be illustrated with the aid of FIGS. 1 and 2.

Figure 1:
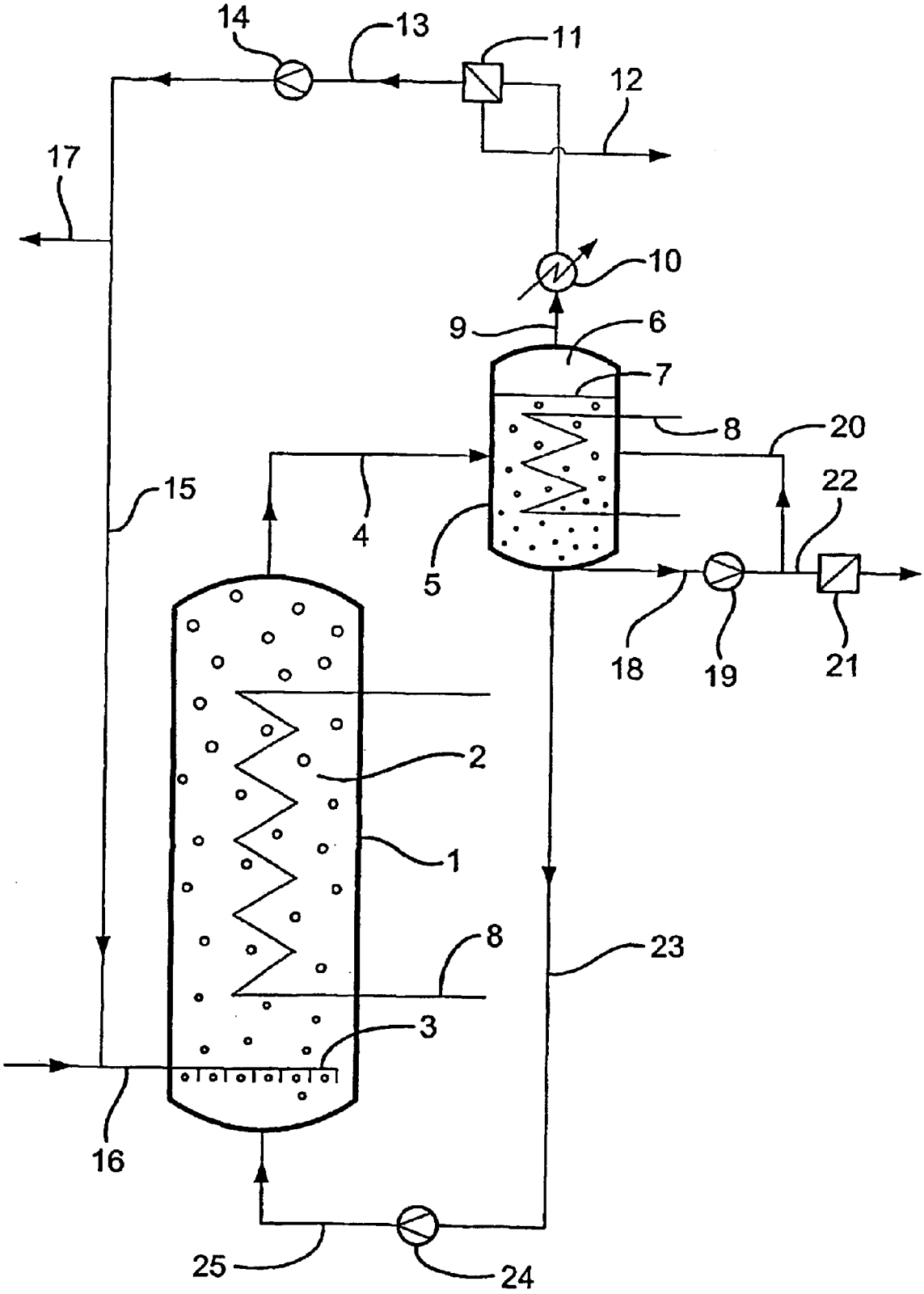
FIG. 1 illustrates the first embodiment of the present invention (external gas separation zone).

Reaction zone (1) is filled with a suspension (2) of catalyst in a liquid medium. The reaction zone (1) is maintained at a temperature of from 180 to 280° C. and at a pressure of from 5 to 50 bar. Syngas is sparged into the reaction zone (1) via sparger (3). A suspension of catalyst in liquid medium and liquid hydrocarbon products (product suspension) is withdrawn from the top of the reaction zone (1) via a line (4) and is introduced into an external gas separation zone (5). A gas cap (6) is present in the gas separation zone (5) above the level of suspension (7) in the gas separation zone. One or more heat exchangers (8), for example cooling coils are positioned below the level of suspension (7) in the gas separation zone (5) and in the reaction zone (1).

A gaseous recycle stream comprising unconverted syngas, gaseous intermediate products, any vaporised low boiling solvent, any vaporised low boiling liquid hydrocarbon products and any vaporised water by-product may be withdrawn from the gas separation zone (5) through line (9). By means of a heat exchanger (10), the gaseous recycle stream may be cooled to a temperature at which liquid condenses out. The condensed liquid (typically comprising low boiling hydrocarbon products, water by-product and any low boiling solvent) may be separated from the gaseous recycle stream in a gas-liquid separator (11). The condensed liquid may be withdrawn from the gas-liquid separator (11) via line (12) and may subsequently be recycled to the reaction zone (1), optionally after having removed water by-product (not shown). The gaseous recycle stream from the gas-liquid separator (11) is recycled to the reaction zone (1) via line (13), compressor/blower (14) and lines (15) and (16). A purge stream may be taken from the gaseous recycle stream via line (17) to prevent the build up of gaseous by-products (e.g. methane) in the reaction zone (1). Fresh syngas may be introduced to the sparger (3) via line (16).

Degassed suspension may be withdrawn from the gas separation zone (1) through line (18) and a portion of the withdrawn suspension is recycled to the gas separation zone (1) via pump (19) and line (20). A portion of the withdrawn suspension is passed from pump (19) to a suitable solid-liquid separator (21) (e.g. a hydrocyclone, a filter, a gravity or magnetic separator, or a distillation zone) via line (22).

Degassed suspension is withdrawn from the gas separation zone (5) via line (23) and is recycled to the reaction zone (1) via slurry pump (24) and line (25).

Figure 2:
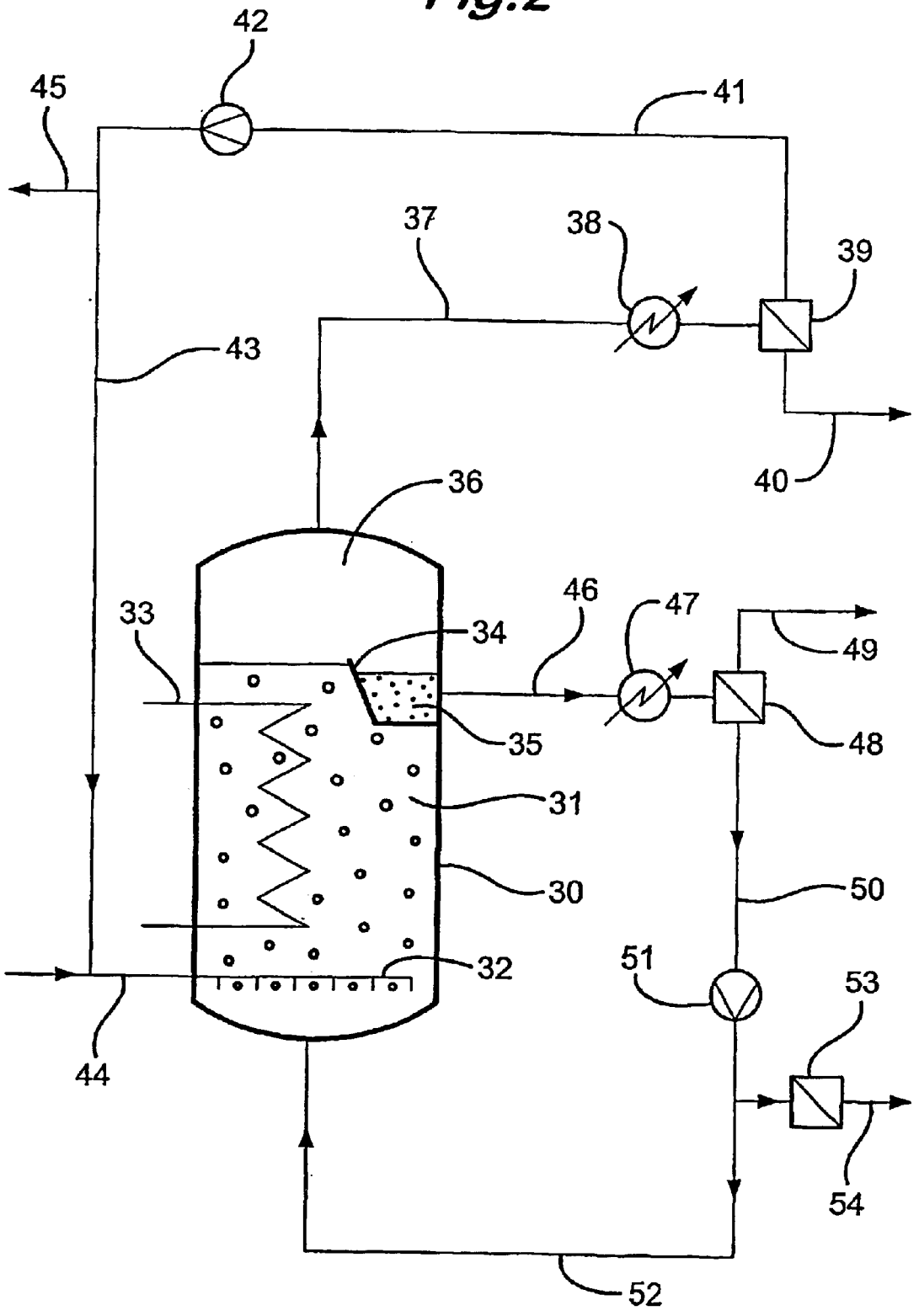

FIG. 2 illustrates the second embodiment of the process of the present invention (internal gas separation zone). Reaction zone (30) is partially filled with a suspension (31) of catalyst in a liquid medium. Syngas is introduced into the reaction zone (30) via sparger (32). The reaction zone (30) is maintained at a temperature of from 180 to 280° C. and at a pressure of from 5 to 50 bar. Cooling coils (33) are positioned below the level of suspension in the reaction zone (1). Fluidising medium flows over a weir (34) into a quiescent region (35) (part of the internal gas separation zone). A gaseous recycle stream comprising unconverted gaseous reactants, any vaporised low boiling liquid hydrocarbon products and any vaporised water by-product is recycled from a gas cap (36) (part of the internal gas separation zone) which is present in the upper part of the reaction zone (30) via line (37). By means of a heat exchanger (38) the gaseous recycle stream passing through the line (37) is cooled to below its dew point to form a two phase mixture of gas and condensed liquid. The condensed liquid typically comprises low boiling hydrocarbon products and water by-product.

The gaseous recycle stream is then passed to a gas-liquid separator (39) where condensed liquid is separated from the gaseous recycle stream. The separated condensed liquid may be removed from the gas-liquid separator via line (40) and may be recycled (not shown) to the reaction zone (30) (after removing any excess water using, for example, a decanter, not shown). The gaseous recycle stream from the gas-liquid separator (39) is recycled to the reaction zone (30) via line (41), compressor/blower (42) and lines (44) and (44). Make-up syngas may be introduced into line (44). A purge stream (45) may be taken from line (43) to prevent the build up of gaseous by-products in the gas cap (36).

Degassed suspension is withdrawn from the quiescent region (35) via line (46) and is cooled by passing the suspension through heat exchanger (47). The degassed suspension is then passed to a further separation zone (48). A gaseous stream is withdrawn from the gas separation zone (48) via line (49)and is either purged or is recycled to the reaction zone (30). Suspension is withdrawn from separation zone (48) via line (50) and is recycled to the reaction zone (30) via a slurry pump (51) and line (52). A product side stream is removed from line (52) and is passed to a suitable solid-liquid separation means (53) (e.g. a hydrocyclone, a filter, a gravity or magnetic separator, or a distillation zone) where the liquid component of the suspension is separated from the catalyst to give a liquid product stream and a concentrated slurry of the catalyst in a residual amount of liquid (not shown). The concentrated slurry of catalyst may be returned to the reaction zone (30) (not shown).

The liquid product stream from the separation means (53) is then passed via line (54) to a purification zone (not shown).

What is claimed is:

1. A process for the production of liquid hydrocarbon products from synthesis gas in a system comprising a reaction zone and a gas separation zone wherein the process comprises:

a) in the reaction zone, contacting synthesis gas at elevated temperature and pressure with a suspension of a particulate Fischer-Tropsch catalyst in a liquid medium so as to convert at least a portion of the synthesis gas into liquid hydrocarbon products;

b) discharging a product suspension comprising catalyst suspended in the liquid medium and the liquid hydrocarbon products from the reaction zone into the gas separation zone, the product suspension having unconverted synthesis gas dissolved and/or entrained therein;

c) in the gas separation zone, separating a gaseous stream comprising unconverted synthesis gas from the product suspension;

d) recycling at least a portion of the separated gaseous stream to the reaction zone; and e) recycling at least a portion of the degassed product suspension from the gas separation zone to the reaction zone.

2. A process as claimed in claim 1 wherein the suspension is cooled by means of a heat exchanger positioned within the reaction zone.

3. A process as claimed in claim 1 wherein the reaction zone is operated without a headspace and wherein the product suspension having unconverted synthesis gas dissolved and/or entrained therein is withdrawn from the reaction zone and is passed to an external gas separation zone.

4. A process as claimed in claim 3 wherein the external gas separation zone is operated with a headspace and wherein the separated gaseous stream is withdrawn from the headspace of the external gas separation zone and at least a portion of the separated gaseous stream is recycled to the reaction zone.

5. A process as claimed in claim 4 wherein a heat exchanger is present below the level of suspension in the external gas separation zone.

6. A process as claimed in claim 3 wherein degassed suspension is withdrawn from the external gas separation zone and is at least in part reintroduced to the external gas separation zone via a by-pass loop conduit.

7. A process as claimed in claim 6 wherein degassed suspension is withdrawn from at or near the bottom of the external gas separation zone and is at least in part reintroduced to the external gas separation zone at a position immediately below the level of degassed suspension in the external gas separation zone.

8. A process as claimed in claim 6 wherein the degassed suspension is passed around the by-pass loop conduit by means of a slurry pump and a product side stream is taken from the by-pass loop conduit downstream of the slurry pump.

9. A process as claimed in claim 3 wherein degassed product suspension is withdrawn from the external gas separation zone and at least a portion of the degassed product suspension is recycled to the reaction zone.

10. A process as claimed in claim 1 wherein the gas separation zone is located inside the reaction zone ("internal gas separation zone").

11. A process as claimed in claim 10 wherein the internal gas separation zone comprises (i) a headspace into which a gaseous phase comprising unconverted synthesis gas is disentrained from the suspension, and (ii) a quiescent region into which the degassed product suspension is discharged.

12. A process as claimed in claim 11 wherein the separated gaseous stream is withdrawn from the headspace of the internal gas separation zone arid at least a portion of the separated gaseous stream is recycled to the reaction zone.

13. A process as claimed in claim 11 wherein degassed product suspension is withdrawn from the quiescent region of the internal gas separation zone and at least a portion of the degassed product suspension is recycled to the reaction zone.

14. A process as claimed in claim 1 wherein the degassed product suspension is cooled, by being passed through an external heat exchanger, before being recycled to the reaction zone.

15. A process as claimed in claim 14 wherein at least a portion of the degassed product suspension is passed to a product separation stage where liquid medium and liquid hydrocarbon products are separated from the particulate catalyst.

16. A process as claimed in claim 15 wherein the separated liquid hydrocarbon products are fed to a hydrocracking stage.

17. A process as claimed in claim 1 wherein the gaseous recycle stream is cooled, by being passed through an external heat exchanger, before being recycled to the reaction zone.

18. A process as claimed in claim 17 wherein fresh synthesis gas is fed to the gaseous recycle stream either upstream or downstream of the external heat exchanger.

19. A process as claimed claim 1 wherein a purge stream is taken from the gaseous recycle stream.

20. A process as claimed in claim 17 wherein the gaseous recycle stream is cooled to below its dew point to form a two phase mixture of gas and condensed liquid.

21. A process as claimed in claim 20 wherein the condensed liquid is either recycled to the reaction zone entrained in the gaseous recycle stream or is separated from the gaseous recycle stream and is recycled to the reaction zone separately from the gaseous recycle stream.

22. A process as claimed in claim 1 wherein a stream comprising a low boiling solvent having a boiling point, at standard pressure, in the range of from 30 to 280° C. is introduced into the reaction zone.

23. A process as claimed in claim 3 wherein a stream comprising a low boiling solvent having a boiling point, at standard pressure, in the range of from 30 to 280° C. is introduced into the external gas separation zone.

24. A process as claimed in claim 1 wherein the catalyst comprises iron or cobalt supported on an inorganic refractory oxide selected from the group consisting of silica, alumina, silica-alumina, the Group IVB oxides, titania and zinc oxide.

25. A process as claimed in claim 1 wherein the particulate Fischer Trospch catalyst has a mean particle size of less than 40 microns.

26. A process as claimed in claim 1 wherein the suspension of catalyst discharged into the gas separation zone comprises loss than 40% wt of catalyst particles.

* * * * *